United States Patent [19]

Anderson et al.

[11] Patent Number: 4,653,759

[45] Date of Patent: Mar. 31, 1987

[54] THREE-PERSON CHESS GAME BOARD

[76] Inventors: Todd L. Anderson; Craig L. Anderson, both of 3705 S.E. 63rd St., Portland, Oreg. 97206

[21] Appl. No.: 699,527

[22] Filed: Feb. 8, 1985

[51] Int. Cl.[4] ..... A63F 3/02

[52] U.S. Cl. ..... 273/261; 273/241; 273/255

[58] Field of Search ..... 273/261, 241, 255, 260, 273/262, 243, 255

[56] References Cited

U.S. PATENT DOCUMENTS

| | | | |
|---|---|---|---|
| D. 215,103 | 9/1969 | Steven et al. | D21/24 |
| D. 231,848 | 6/1974 | Mobert | D21/24 |
| 3,533,627 | 10/1970 | Deffenbaugh et al. | 273/261 |
| 3,744,797 | 7/1973 | Hopkins | 273/261 |
| 3,840,237 | 10/1974 | Shkolnik | 273/261 |
| 3,963,242 | 6/1976 | Treugut et al. | 273/261 |
| 4,067,578 | 1/1978 | Chang | 273/261 |
| 4,249,741 | 2/1981 | Buijtendorp | 273/261 |

FOREIGN PATENT DOCUMENTS

| | | | |
|---|---|---|---|
| 218607 | 2/1910 | Fed. Rep. of Germany | 273/241 |
| 2228465 | 1/1974 | Fed. Rep. of Germany | 273/261 |
| 1597713 | 9/1981 | United Kingdom | 273/261 |

*Primary Examiner*—Richard C. Pinkham
*Assistant Examiner*—Matthew L. Schneider
*Attorney, Agent, or Firm*—Henderson & Sturm

[57] ABSTRACT

The disclosure is of a three-person chess game and board having a central playing area in the form of an equilateral triangle bordered at each of its three sides by a rectangular playing field or area having at least two rows of eight squares each according to at least part of the conventional chess or checker board. Each rectangular field is contiguous with its side of the triangle and moves are made from the rectangle into the triangle and subsequently into either of the other rectangles according to prescribed rules. At least some of the moves are dictated by an element of chance, such as the roll of one die. The rectangles are identical and three conventional chess sets are used, albeit these may be of contrasting colors as may be the markings of the chess board squares as well as the smaller triangles into which the basic central triangle is subdivided.

1 Claim, 5 Drawing Figures

Fig. 1
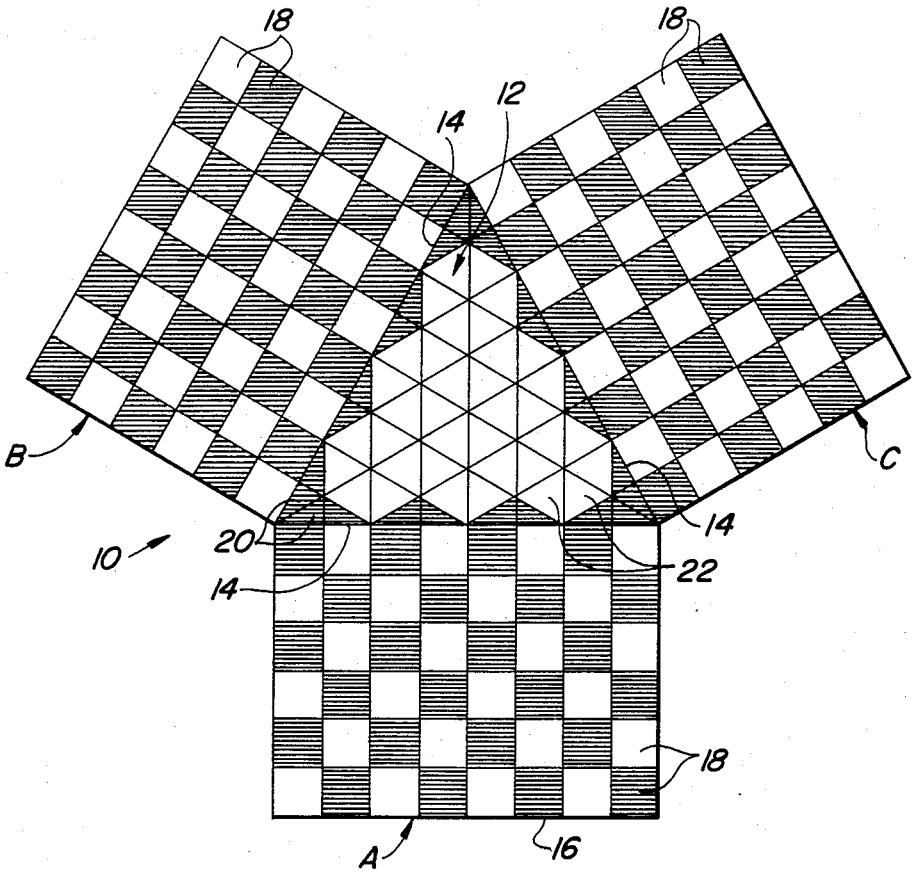
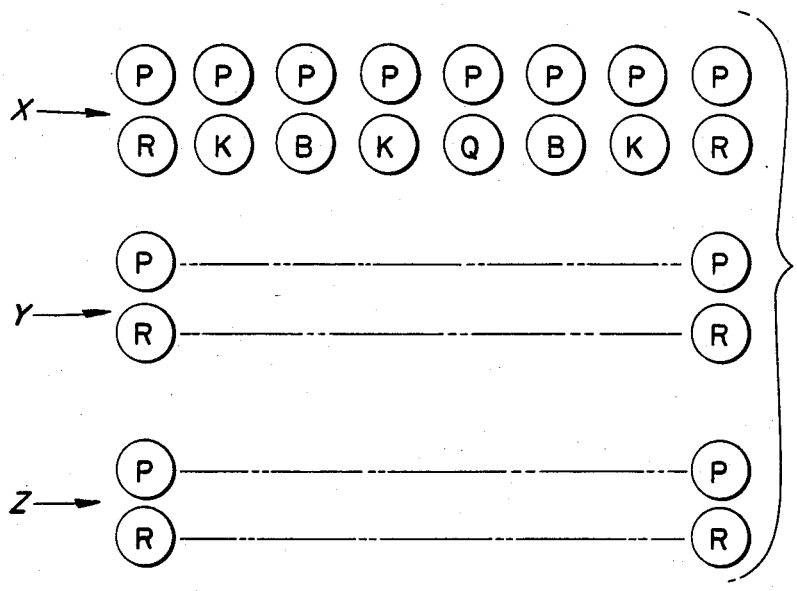
Fig. 2

THREE-PERSON CHESS GAME BOARD

BACKGROUND AND SUMMARY

The basic idea of three-person chess has been exploited in several forms in the prior art, the fundamentals revolving about some form of triangular playing field bearing squares or other markings over which game pieces are moved according to prescribed rules. In some prior art games, the usual checkerboard pattern is modified. In others, the conventional chess set is either added to or subtracted from by the addition of pieces of new names, for example. In cases where the set is reduced, it is normally at least one of the pawns that has been deleted. Usually, the basic rules are modified for the purpose of accommodating the different numbers of pieces or to change the approach to the game. Representative of such patented prior art are the following U.S. Pat. Nos. 3,963,242; 3,744,797 and 3,533,627.

The present invention provides significant advances and improvements over such prior art, particularly in the symmetrical form of playing field and its subdivisions, the use of conventional chess sets, the use, at least in part, of basic rules of chess and the introduction into the game of the element of chance, specifically by the use of one die to dictate certain moves of the chess men. Features and advantages other than are complementary to the foregoing will become apparent from the following disclosure of a preferred form of the invention.

DESCRIPTION OF TH DRAWINGS

FIG. 1 is a plan of the playing board.

FIG. 2 is representative, in part schematic, of the three chess sets employed.

DETAILED DESCRIPTION OF A PREFERRED EMBODIMENT OF THE INVENTION

Figure 3:
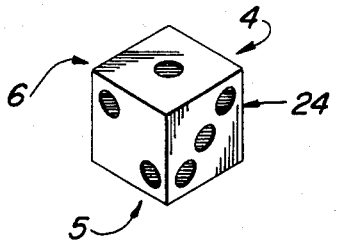
FIG. 3 is a perspective of a typical single die that may be used.

Reference will be had first to FIG. 1, wherein the novel game board is designated in its entirety by the numeral (10). This board, in one form of the invention, has a flat top on which four basic playing fields or areas are imprinted or otherwise delineated. The central area is in the form of an equilateral triangle (12) bordered at its three edges, respectively, by rectangular playing fields A, B and C. These rectangles are identical and accordingly the description of one will suffice for all, with exceptions made where necessary for clarification of the disclosure. Each rectangle has an inner side 14 coincident as to position and length with the associated or adjacent side of the basic central triangle, the rectangles being disposed about the triangle in 120° spaced apart intervals, forming generally Y. The side 14 of a rectangle may be said also to represent the associated side of the basic central triangle (12). Each rectangle further has, of course, an outermost side (16) parallel to its innermost side. The rectangles are of conventional chess or checkerboard style and each has at least two starting rows (18) of eight squares each. In the present instance, each chess "board" has six rows of alternately colored squares. The squares of the rectangles may be of contrasting colors, e.g., black and red. The triangles could be yellow. Considerable latitude is allowed in this area of design and attractiveness. The selection of six rows of squares for each rectangle is based mainly on the usual number of four rows on a standard chess board separating the rows of competing pawns. In the present case, there are four rows between each pawn row and the adjacent innermost side (14) (or coincident triangle side). The number of rows could, of course, be varied.

It is a feature of the invention that three sets of conventional chess pieces or men may be used, as represented by the three sets X, Y and Z in FIG. 2. These sets may be of contrasting colors; e.g., a red set, a blue set and a white set. Here again wide variation is permitted without departing from the spirit of the novel game. It is clear, of course, that the sets X, Y and Z will begin the game arrayed in conventional chess fashion on the rectangular fields A, B and C, respectively.

Figure 4:
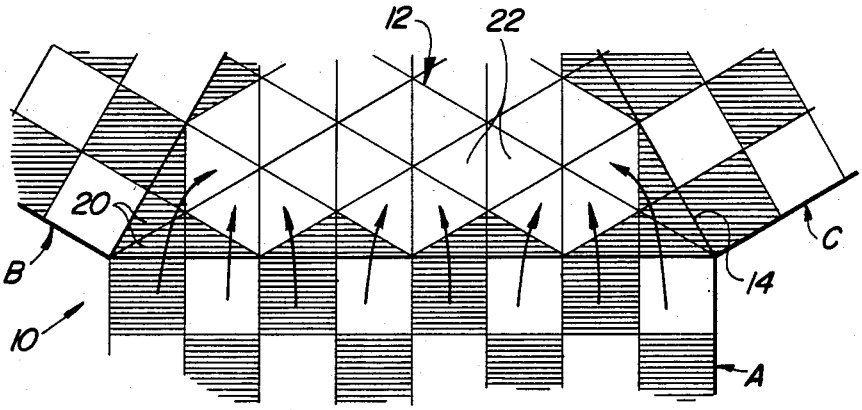
FIG. 4 is a fragmentary view of part of the board, showing how moves are made from a rectangular field into the triangular area.

The basic central triangle (12) is subdivided into several smaller triangles, specifically three rows of isoceles triangles (20) having their bases aligned on the respective sides (14) and a plurality of identical equilateral small triangles (22) within the isoceles rows. The isoceles triangles are identical to each other and each has a base of such length as to span two squares in the adjacent board row. The other two sides of each isoceles triangle are equal to the sides of the small equilateral triangles. The relationship of the triangles to each other and to the bordering chess board squares is best seen in FIG. 4. The aforesaid pattern establishes ideal symmetry as respects the three chess boards, A, B and C.

Although wide latitude may be resorted to in the rules governing the play of the game, it is a significant feature that the game is made more entertaining by the use of means providing an element of chance or "luck". One such means may take the form of a single die (24) as depicted in FIG. 3. As one variation in this area, additional dice (not shown) may be used; or some form of numbered or lettered spinner (also not shown) could be employed. Each player may have his own die of a color matching his chess set.

Fundamentally, the object of the game is, of course, to check mate the opponents' kings. The rules may provide that, initially, each chess piece can be moved in turn according to the usual moves assigned to those pieces accordto standard chess. As the men from board A, for example, advance, they approach the central triangle. At this point, the rules may provide that a roll of the die determines whether the advanced piece can enter the triangle. For example, if the die comes up 1, 2 or 3, advance may be made into the next adjacent triangle (22). Casting of the die is then used to determine how many small triangles (22) may be traversed. The player may be required to announce, before he rolls the die, that he desires to enter the central triangle and which piece he will move. The rules may further provide that a roll of the die must result in numbers 4, 5 or 6 as "permission" to leave the central triangle.

If a small triangle (22) is already occupied, the player must move his piece to the nearest empty triangle. Pieces in the triangle may not capture or be captured with one exception: the queen can capture pieces within the central triangle if the number of the die corresponds to the number of spaces the queen must move to make the capture. The queen may also capture pieces while leaving the central triangle, a privilege that may be denied the other pieces. Once a king is inside the triangle, stalemate occurs. Check mate on any opponent means that a piece previously captured from the check mated opponent may be placed within the central triangle by the person effecting the check mate.

Figure 5:
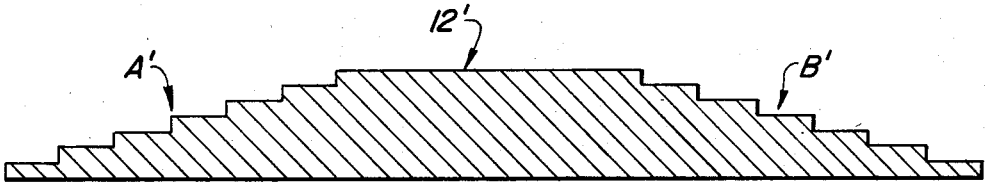
FIG. 5, is a section showing a modified board having steps therein.

In the "stepped" form of playing board shown in FIG. 5, the central triangle (12) is elevated and the rows of squares in the adjoining fields A, B and C are stepped down from the triangle (12). The figure has been drawn as a view taken on a "bent" section line.

As stated previously, the rules just outlined may be varied, and many variations will occur as the players gain experience. For example, it may be required that 1 on the die must be rolled in order to enter the basic triangle and 2 must be rolled to get out. These and other variations may be resorted to while the basic concept of the three-person board and the use of means providing an element of chance, all without departure from the spirit and scope of the invention.

We claim:

1. An apparatus for playing three-person chess, comprising a game board including a central playing area in the form of a basic equilateral triangle and three identical rectangular playing fields disposed around the triangle in 120° spaced apart fashion with said triangle as a center and respectivley having innermost sides coincident as to position and length with the sides of the triangle and outermost sides parallel to the respective innermost sides, each rectangular field being checkered in conventional chess-board style and including six rows of eight squares, each row paralleling the respective innermost and outermost sides, said basic triangle being subdivided into a plurality of smaller triangles contiguous with each other, certain of said smaller triangles being bordering triangles lying in three rows respectively along the sides of the basic triangle and respectively contiguous with the innermost rows of squares of the respective rectangular fields, the smaller triangles other than the bordering triangles being equilateral and identical to each other, each bordering triangle being isosceles and having a base lying on an adjacent side of the basic triangle, said base being of such length as to span two adjacent rectangular field, and each side of each bordering triangle being coincident with a side of the next adjacent smaller triangle the bordering triangle having indicia thereon that distinguishes them from all of the other smaller triangles.

* * * * *

UNITED STATES PATENT AND TRADEMARK OFFICE

CERTIFICATE OF CORRECTION

PATENT NO. : 4,653,759

DATED : March 31, 1987

INVENTOR(S) : Todd L. Anderson, et al

It is certified that error appears in the above-identified patent and that said Letters Patent are hereby corrected as shown below:

In Column 4, line 19, -- squares of the adjacent row of squares in the adjacent -- should be inserted between "adjacent" and "rectangular"; in column 4, line 21, "triangle" second occurrence should read --triangles--.

Signed and Sealed this

Twelfth Day of April, 1988

*Attest:*

DONALD J. QUIGG

*Attesting Officer*

*Commissioner of Patents and Trademarks*